United States Patent [19]

Wildblood et al.

[11] Patent Number: 4,668,042

[45] Date of Patent: May 26, 1987

[54] ELECTRICAL CONNECTORS

[75] Inventors: Robin Wildblood; Michael D. Harcourt, both of Coventry, England

[73] Assignee: The General Electric Company, p.l.c., England

[21] Appl. No.: 786,332

[22] Filed: Oct. 10, 1985

[30] Foreign Application Priority Data

Oct. 10, 1984 [GB] United Kingdom ..... 8425640

[51] Int. Cl.[4] ..... H01R 13/40

[52] U.S. Cl. ..... 339/176 M; 339/217 R

[58] Field of Search ..... 339/176 MP, 176 R, 176 M, 339/191–194, 217 R, 220, 221

[56] References Cited

U.S. PATENT DOCUMENTS 3,160,459 12/1964 Greco et al. ..... 339/176 MP 3,172,717 3/1965 Clewes ..... 339/176 MP 3,218,603 11/1965 Sanislo ..... 339/176 MP 3,243,761 3/1966 Piorunneck ..... 339/176 MP

*Primary Examiner*—Joseph H. McGlynn

*Attorney, Agent, or Firm*—Kirschstein, Kirschstein, Ottinger & Israel

[57] ABSTRACT

An electrical socket connector in which individual contact members are located and retained on pegs projecting from a body member of electrically insulating material, the contact members being arranged for insulation displacement electrical connection at one end to insulated wires of two different thicknesses, and having means to set the gap between contact-making cantilever springs for co-operation with an associated plug connector. Outer covers may be latched to the body member, and the body member or one of said covers may allow access to said contact members for test probes.

4 Claims, 7 Drawing Figures

ELECTRICAL CONNECTORS

BACKGROUND OF THE INVENTION

The present invention relates to electrical connectors.

SUMMARY OF THE INVENTION

According to one aspect of the present invention in cable-mounting electrical plug or socket connector a cover member of said connector is arranged to be retained in position by means of a cantilever projection which is moulded integrally as part of said cover member and which is arranged to interengage with a portion of another member of said connector.

Preferably said other member of said connector is a second cover member. The two cover members may each have at least one cantilever projection which interengages with a respective portion of the other cover member. One or more dowel-like projections on a body portion of said connector may also serve to locate said cover member or members with respect to said body portion.

According to another aspect of the present invention in an electrical plug or socket connector comprising a body member of electrically insulating material and one or more contact members located in position with respect to said body member at least in part by respective boss means formed integrally with and projecting from said body member, each said boss means being arranged to project into or through a hole in the respective contact member, there is provided at the base of each boss means an annular recess in said body member arranged to accept any of the electrically insulating material of said boss that may be removed or displaced by the positioning of a contact member on said boss.

Preferably each said boss means has a lobed cross-section, being formed with a plurality of longitudinally extending ribs which taper towards the free end of said boss. The said hole in each respective contact member is preferably sized to provide an interference fit with at least the outer edges of said ribs.

According to another aspect of the present invention in an insulation displacement connector of the kind in which electrical connection is effected between a contact member and an electrically insulated wire by insertion of said wire transversely of its length into an open-ended slot in said contact member of a width such that the edges of the contact member defining the slot make conductive contact with the wire by localised displacement of the electrical insulation thereof, the slot in said contact member comprises regions of two different widths, the wider region being nearer the open end of the slot, whereby electrical connection to said contact member with a wire of either of two different thickness may be effected by insertion of said wire into the slot to a respective different depth.

One or more contact members may be mounted on a connector body member of electrically insulating material, and there may be provided means on said body member to grip the insulation on the wire or wires connected to said contact member or members to avoid or reduce stressing of the electrical connection or connections. The means to grip the insulation may comprise a slot in an upstanding rib of said body member, adjacent said contact member or members, into which the insulated wire is inserted as the respective electrical connection is effected, said slot having respective regions of two different widths to grip the insulation on said wires of two different thicknesses.

According to another aspect of the present invention in an electrical socket connector in which each of one or more female contacts carried by a body member of electrically insulating material comprises a pair of cantilever springs arranged to bear respectively on opposite faces of a respective male contact of a corresponding plug connector, there are provided in said socket connector means of electrically insulating material extending between opposed portions of said cantilever springs to determine the minimum gap between said springs in the absence of said corresponding male connector.

Preferably said means is moulded intergrally with the body member, and is provided with a recess into which the free end of said male contact extends to restrain sideways movement of said contact.

According to another aspect of the present invention in an electrical socket connector in which one or more female contacts are carried at least partly within a connector housing of electrically insulating material, said connector housing being provided with respectively one or more apertures through which respective male contacts may be brought into engagement with said one or more female contacts, the edges of each said aperture are arranged to bear on a respective male contact in a direction transverse to the direction of insertion of a male contact into said engagement such as to contribute to forces retaining said male contact in said engagement.

Preferably each said male contact is of substantially rectangular cross-section, and the edges of the respective aperture bear on opposed faces of said male contact that are not utilised in making electrical connection with the respective female contact.

According to another aspect of the present invention in an electrical plug or socket connector comprising one or more electrical contact members carried at least partially within a housing of electrically insulating material, there are provided in said housing one or more apertures each providing access for an electrical test probe to make electrical contact with a respective one of said one or more electrical contact members.

BRIEF DESCRIPTION OF THE DRAWING

An electrical connector in accordance with the present invention will now be described by way of example with reference to the accompanying drawings, of which.

DETAILED DESCRIPTION OF THE PREFERRED EMBODIMENTS

Figure 1:
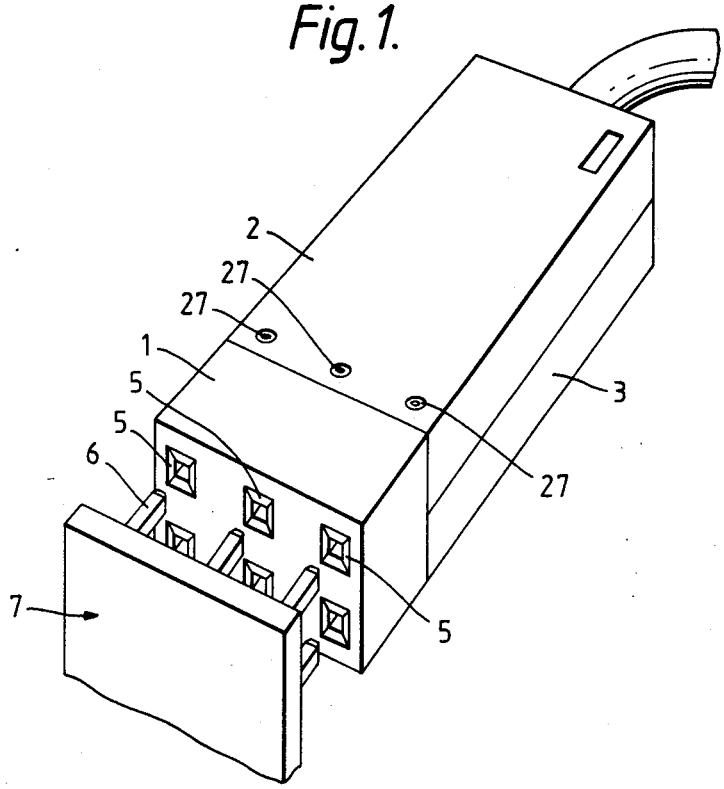
FIG. 1 shows the connector diagrammatically.
Figure 7:
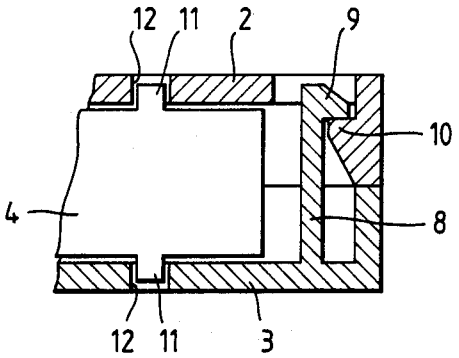
Figure 2:
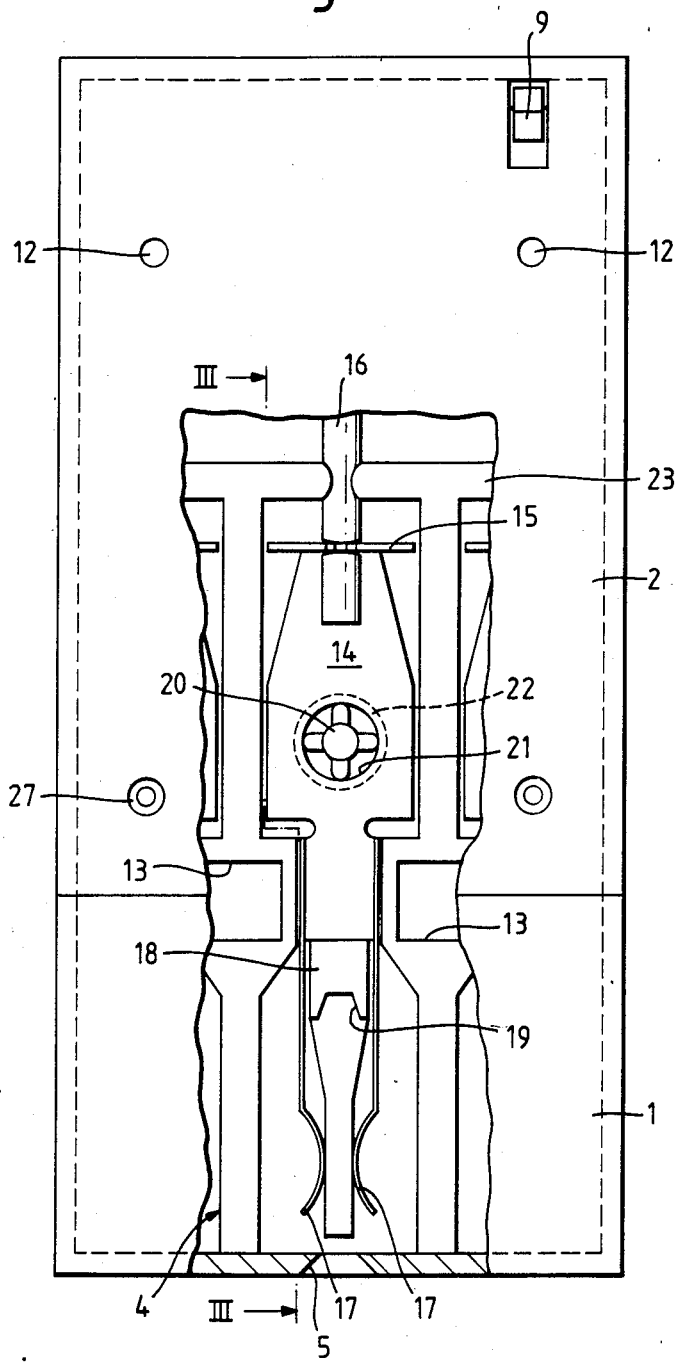
FIG. 2 shows a part cut-away view of a connector of the form shown in FIG. 1.

Referring first to FIG. 1 the electrical connector, a socket connector, comprises a cover or housing in three parts, an end cover 1 and two similar side covers 2 and 3. As indicated in FIGS. 2 and 7 the cover members 1, 2 and 3 enclose a body member 4, the end cover 1 being provided with apertures 5 to permit the entry of pins 6 of a corresponding plug connector 7. The parts 2 and 3 of the cover are arranged to latch together by means of two cantiliver projections 8 only one of which is shown in FIG. 7, these projections 8 being moulded integrally with respective covers 2 and 3 and having end portions 9 shaped to latch behind ramped projections 10 on the other cover.

The covers 2 and 3 are restrained from moving with respect to the body member 4 by projections or lugs 11 fitting within holes 12 in the respective covers. Similarly the end cover 1 engage lugs (not shown) on the body member 4, and the covers 2 and 3 are provided with projections (not shown) which engage the edges of the end cover 1 and extend into recesses 13 in the body member 4, see FIG. 2, so as further to locate the cover members with respect to one another and with respect to the body member 4.

Figure 3:
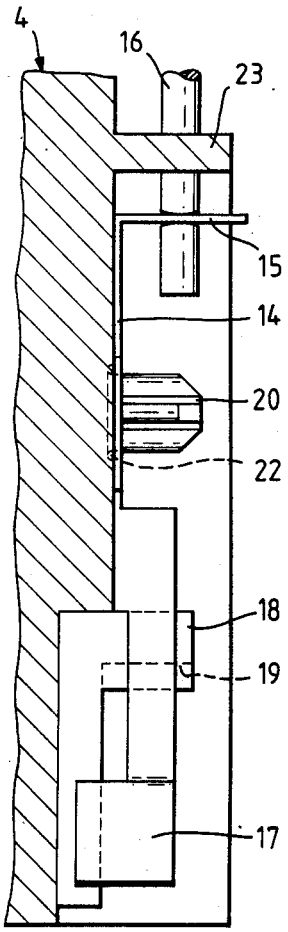
FIG. 3 is a part-sectional view on the line III—III in FIG. 2, and FIGS. 4 to 7 are fragmentary views of the connector shown in FIG. 2.

Referring now particularly to FIGS. 2 and 3 the body member 4 carries six electrical contacts 14 formed from sheet metal to provide at one end an up-standing insulation displacement connector 15 to an electrically insulated wire 16, and at its other end a pair of opposed cantilever spring arms 17. In respect of each of the contacts 14 the body member 4 is provided with an integrally moulded up-standing rib 18 which extends between the cantilever spring arms 17 to establish their minimum separation at their contact-making region, and which provides a recess 19 in which the tip of a respective plug contact pin 6 (not shown in FIG. 2) rests to restrain relative lateral movement between the respective contacts. When formed the contacts 14 are subject to fairly large manufacturing tolerances due to the press forming of the two right-angle bends and the radii forming the contact regions of the spring arms 17. When the contacts 14 are subsequently fitted to the body member 4 the ribs 18 hold the spring arms 17 apart to establish the above-mentioned minimum separation.

The contacts 14 are located and retained with respect to the body member 4 by means of respective bosses 20 which are moulded integrally with the body member 4 and which each comprise a central portion bearing four tapered lobes. A corresponding location hole 21 provided in each contact 14 is sized to provide an interference fit on the lobes of the respective boss 20, and an annular recess 22 is provided around the base of each boss 20 to collect any debris scraped from the lobes as the contact 14 is fitted, so that the contact 14 can be seated in abutment with the body member 4.

Figure 4:
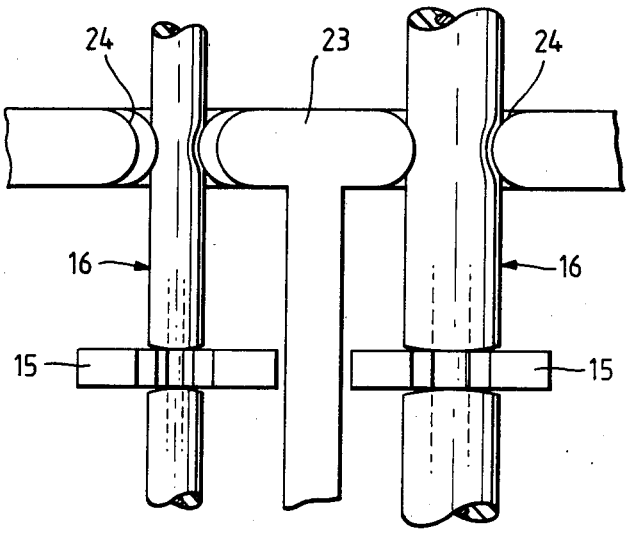
Figure 5:
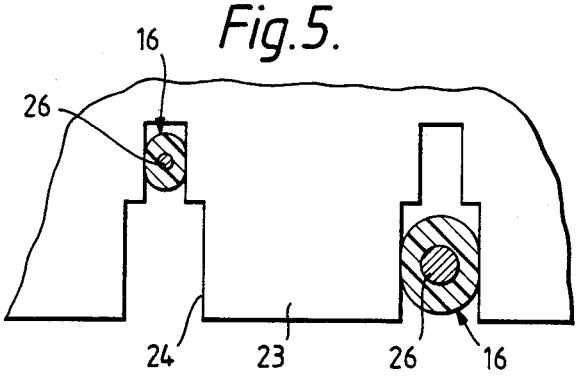
Figure 6:
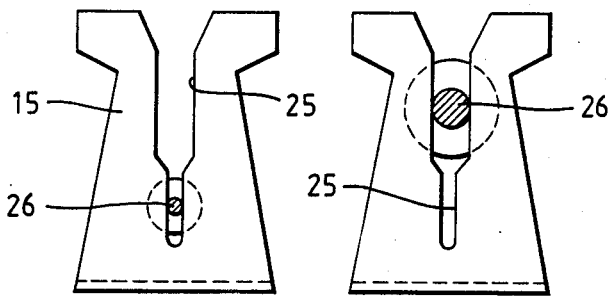

The body member 4 is provided with an integrally moulded up-standing rib 23 having respective slots 24 adjacent the insulation displacement connectors 15, these slots being sized to grip the insulation of a respective wire 16 without cutting it to provide a measure of strain relief. As shown in the fragmentary views of FIGS. 4 to 6 the slots 24 have regions of different widths to accommodate wire insulation of different outer diameters, and the insulation displacement connectors 15 each have slots 25 for the conductors 26 with regions of different width for conductors of different thicknesses. In the form illustrated wires 16 of two different sizes may be accommodated by selecting the appropriate depth of insertion into the slots 24 and 25.

In order to keep the electrical contact forces to a level sufficient only for acceptable electrical connection, in terms of contact resistance, retentive forces to keep the plug connector 7 fully engaged are provided by the upper and lower edges of the apertures 5 (as oriented in FIG. 1), which are spaced apart by a distance slightly less than the distance between the respective faces of the pins 6. The electrically insulating material of which the end cover 1 is moulded is slightly resilient, so that the edges of the apertures 5 tend to grip the pins 6 on their non contact making faces.

As shown in FIGS. 1 and 2 test access holes 27 are provided in the side covers 2 and 3 to permit electrical contact to be made to a region of each contact 14 between the spring arms 17 and the insulation displacement connector 15. This permits separate testing of the "plug-up" connection and the wire connection, and avoids the need to insert test probes into the socket by way of the apertures 5.

Referring again to FIG. 7, in an alternative arrangement the two cantilever projections 8 may both be moulded integrally with the body member 4 instead of with the respective covers 2 and 3.

We claim:

1. An electrical socket connector for use with a plug connector having a plurality of contact pins each of substantially rectangular cross-section, comprising: a body member of electrically insulating material, a plurality of female contact members each having a pair of cantilever spring contacts arranged to bear respectively on opposed faces of a respective contact pin of the associated plug connector, and means to secure each said female contact member to said body member, said body member being provided in respect of each said female contact member with an upstanding rib which extends in the direction of insertion of said plug contact pins into engagement with the respective female contact members, which rib lies between the cantilever spring contacts of the respective female contact members substantially at their contact-making region to determine a minimum gap between said spring contacts at that region, and which provides a recess to receive the tip of a respective plug contact pin, whereby a said contact pin is restrained from relative lateral movement between said contact springs.

2. An electrical socket connector in accordance with claim 1, wherein said body member is arranged to be enclosed at least partly within a housing member, and said housing member is provided with a plurality of apertures through respective ones of which the contact pins of the associated plug connector may be brought into engagement with respective ones of said female contact members, the edges of the housing member defining said apertures being arranged to bear on respective contact pins in a direction transverse to the direction of insertion of said pins into said engagement such as to contribute to forces retaining said male contact in said engagement.

3. An electrical socket connector in accordance with claim 2, wherein said edges of the housing member are arranged to bear on opposed faces of said contact pins that are not utilized in making electrical connection with the respective female contact member.

4. An electrical socket connector in accordance with claim 1, wherein said means to secure each said female contact member to said body member comprises respective boss means formed integrally with and projecting from said body member, each said boss means being arranged to project through an aperture in the respective female contact member, and there is provided at the base of each boss means an annular recess in said body member arranged to accept any of the electrically insulating material of said boss means that may be displaced by the positioning of a female contact member on said boss means.

* * * * *